US005921278A

United States Patent [19]

Wallace et al.

[11] Patent Number: 5,921,278

[45] Date of Patent: Jul. 13, 1999

[54] COMPOSITE TANK FOR INDUSTRIAL FINISHING EQUIPMENT

[75] Inventors: Gregory M. Wallace, Evansville; J. Steve Whitehead, Newburgh; David W. Carl, Poseyville, all of Ind.

[73] Assignee: George Koch Sons, Inc., Evansvile, Ind.

[21] Appl. No.: 08/667,672

[22] Filed: Jun. 21, 1996

[51] Int. Cl.[6] ..... B65D 25/14; B08B 3/04

[52] U.S. Cl. ..... 137/563; 134/111; 220/62.22; 220/565

[58] Field of Search ..... 137/563, 590; 220/4.13, 565, 567.2, 62.22; 134/111

[56] References Cited

U.S. PATENT DOCUMENTS

| | | | |
|---|---|---|---|
| 1,899,657 | 3/1933 | Zademach | 134/111 X |
| 2,175,677 | 10/1939 | Zademach | 136/111 |
| 2,418,934 | 4/1947 | Hirsch | 134/111 X |
| 2,698,627 | 1/1955 | Kearney et al. | 134/111 X |
| 2,842,143 | 7/1958 | Kearney | 134/111 X |
| 2,872,079 | 2/1959 | Moore | 220/4.13 X |
| 3,505,769 | 4/1970 | Miron et al. | 220/567.2 X |
| 3,616,963 | 11/1971 | Sinnott | 220/678 |
| 3,904,524 | 9/1975 | Pelton et al. | 220/62.22 X |
| 3,971,394 | 7/1976 | Osborne | 134/111 X |
| 4,068,777 | 1/1978 | Humphrey et al. | 220/565 |
| 5,056,552 | 10/1991 | Berman | 137/563 X |
| 5,108,554 | 4/1992 | Deters | 205/145 |
| 5,269,436 | 12/1993 | Bachmann | 220/62.22 X |

OTHER PUBLICATIONS

Isocyanurate–Polyurethane Board Insulation, Elfoam Insulation Products sales literature, date unknown.

*Primary Examiner*—John Rivell
*Attorney, Agent, or Firm*—Barnes & Thornburg

[57] ABSTRACT

A composite tank for a rinse system comprises a plate, a plurality of general planar fiberglass reinforced plastic walls, and a generally planar bottom wall. The plurality of general planar fiberglass reinforced plastic walls are attached to the plate and extend generally upwardly therefrom. The walls cooperate with the plate to define an interior region of the tank. The generally planar bottom wall is positioned to lie above the plate and is received in the interior region of the tank. The bottom wall is made from fiberglass reinforced plastic and is attached to the reinforced plastic walls to provide a sealed interior region of the tank between the walls and the bottom wall and above the plate.

15 Claims, 6 Drawing Sheets

COMPOSITE TANK FOR INDUSTRIAL FINISHING EQUIPMENT

BACKGROUND SUMMARY OF THE INVENTION

The present invention relates to industrial finishing equipment and particularly to a composite tank for use with industrial finishing equipment. More particularly, the present invention relates to a composite tank that can be used in an industrial washer or an industrial rinse machine such as a post rinse machine that is installed in-line following an electrodeposition coating station, the tank resisting the corrosive effects of chemicals such as deionized water often found in rinsing operations for rinsing work pieces.

It is well known that cleaning and rinsing solutions used in industrial finishing equipment, including deionized water (DI water), can corrode metal parts exposed to the solution. In response, manufacturers of industrial finishing equipment have replaced many metal parts with replacement parts made from corrosion resistant materials such as stainless steel. Manufacturers have also coated exposed metal parts with corrosion resistant coatings such as plastics materials and fiberglass reinforced plastics to protect the parts against corrosion. For example, U.S. Pat. No. 5,108,554 to Deters discloses that such corrosive resistant coatings may include a zinc layer applied by electroplating, a chromate layer over the zinc, and a final coating with a synthetic resin.

What is needed is a tank for use in industrial finishing equipment that is inexpensive and easy to manufacture and yet can withstand exposure to corrosive chemicals without deteriorating. In addition, manufacturers and users of such industrial finishing equipment would appreciate such a low-cost tank having a construction that would permit the tank to have an odd-shaped or custom-shaped "foot print" so that the tank can be installed in a location requiring the tank to have a non-rectangular shape.

According to the present invention, a composite tank for use with industrial finishing equipment is provided. The tank includes a generally planar bottom plate. Wall panels made from fiberglass reinforced plastic are attached to the bottom plate and extend generally upwardly therefrom so that the wall panels cooperate with the bottom plate to define an interior region of the tank. The upwardly-facing surface of the bottom plate and portions of the wall panels adjacent to the bottom plate are coated with fiberglass reinforced plastic to provide the tank with a seamless and water impermeable interior.

In preferred embodiments, the tank includes a generally planar bottom plate made from a material providing structural support for the tank and acting as a substrate for the fiberglass reinforced plastic (FRP). Preferably, the bottom plate is sloped so that particulates and debris in the solution carried by the tank will tend to settle adjacent to the downward portion of the bottom plate. The bottom plate includes a plurality of generally straight edges defining the perimeter of the bottom plate.

A plurality of generally planar wall panels made from FRP are attached to the bottom plate. The bottom plate is formed to include a perimetral edge including a plurality of generally straight edges and each wall panel is positioned to lie against a straight edge on the perimeter of the bottom plate. If desired, in the case of a particularly lengthy bottom plate edge, wall panels can be placed side-by-side along the edge to accommodate the lengthy side of the tank. The bottom plate cooperates with the wall panels to define an interior region of the tank.

The bottom plate is preferably coated with FRP and the wall panels are preferably "glassed" to one another and to the bottom plate by applying FRP to the bottom plate, to the bottoms of the wall panels adjacent to the bottom plate, and to the seams between adjacent wall panels so that the inside of the tank is seamless. Coating the bottom plate with FRP and providing the tank with the seamless construction allows for construction of the tank including a bottom plate made from a number of materials such as stainless steel, black iron, wood, or any other suitable material that will provide a substrate for holding the FRP.

If desired, the bottom plate can be made from a foam material, such as isocyanurate-polyurethane foam commonly used as insulation material (hereinafter foam), so that the bottom plate can be easily shaped. For example, a foam bottom plate can be formed in the shape of a wedge so that a bottom of the wedge which defines the outside bottom wall of the tank is generally horizontal and the top of the wedge, which defines the inside bottom wall of the interior region of the tank, is sloped.

The bottom plate can also be shaped to provide the tank with an odd-shaped "foot print" so that the positioning of the tank can be customized to match the floor space limitations of the installation site. For example, if the bottom plate is L-shaped, then the plurality of wall panels attached to the bottom plate will include a minimum of six wall panels so that the tank has a generally L-shaped footprint. It can be seen that the bottom plate can be any of a number of shapes including being square, rectangular, T-shaped, and any other shape of practical significance that can be made using generally straight sides.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Industrial finishing equipment typically includes a continuous conveyor configured to suspend and pass work pieces to be finished, typically fabricated metal articles, in front of work stations designed to complete various finishing tasks on the work pieces. The conveyor is arranged to transport the work pieces to various work stations that can be arranged in an "in-line" manner to facilitate continuous operation of the conveyor and continuous movement of the work pieces. The in-line configuration typically includes closely spaced work stations arranged so that finishing operations are performed on the work pieces in rapid progression. Industrial finishing equipment work stations, however, can also be made to stand alone as individual work stations.

Among the tasks to be performed on work pieces is work piece washing, both prior to finishing and, in some cases, after finishing the work pieces. Both governmental restrictions and ever increasing customer quality expectations continue to increase the complexity of surface washing processes which typically include multiple cleaning and rinsing stages. These complex processes in turn raise the demands on the cleaning and rinsing equipment. Manufacturers involved in industrial finishing have a substantial and growing need for simple, flexible, and durable washing stations.

Figure 1:
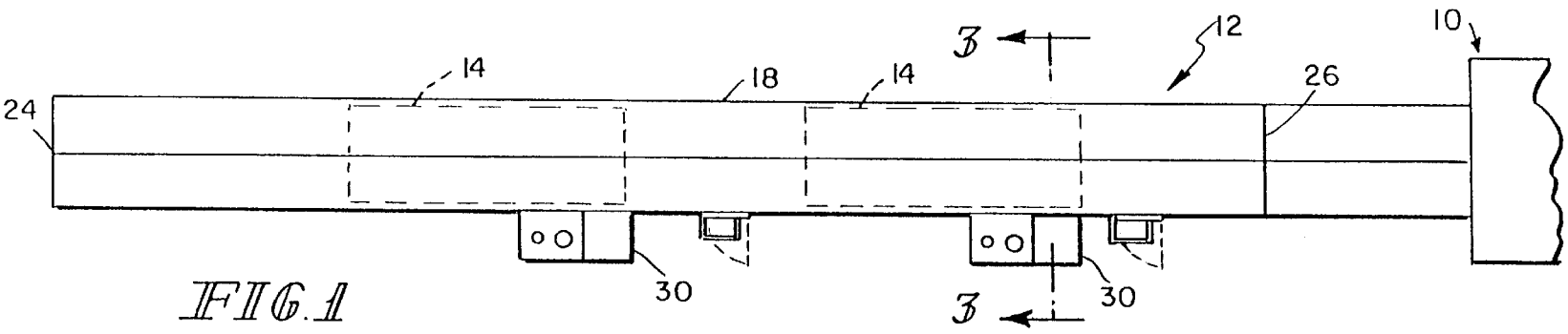
FIG. 1 is a top plan view of a post-rinse machine positioned in a work stream adjacent to and following an electrodeposition coating station, the post rinse machine including a pair of tanks (in phantom) in accordance with the present invention showing the tanks in-line with the electrodeposition coating machine.
Figure 2:
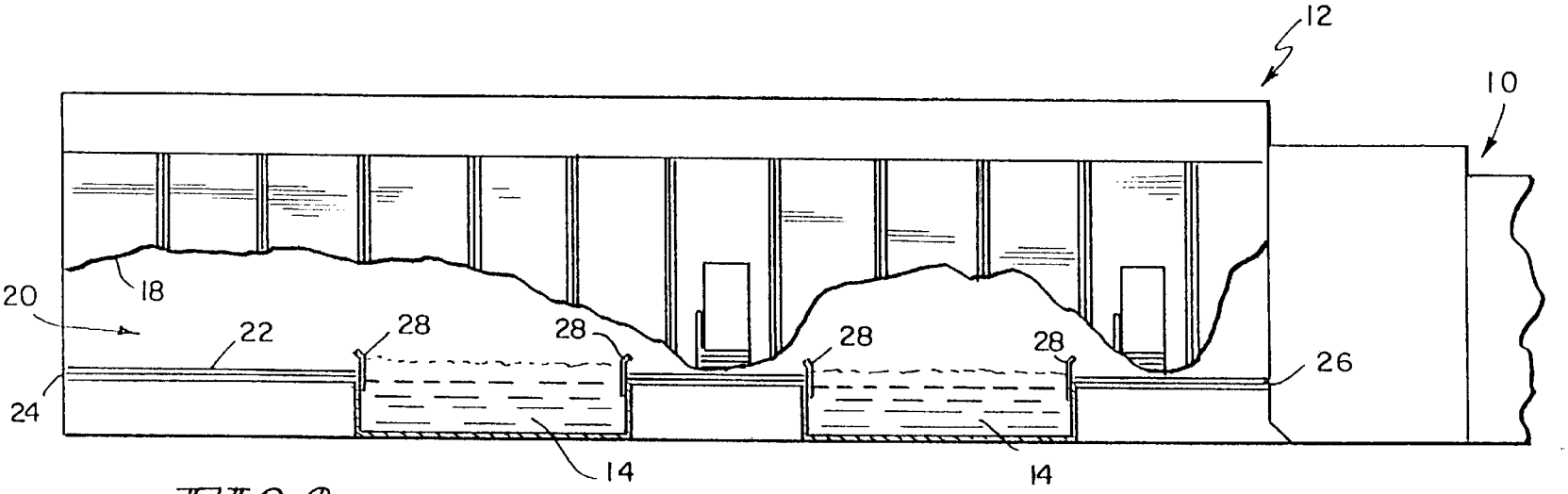
FIG. 2 is an elevation view of the post-rinse machine of FIG. 1 showing sloped drain boards positioned to lie along the length of the post rinse machine and between the tanks, the tanks being filled with solution that is cascading along the drain boards and through the tanks back to the electrodeposition coating machine, the tanks including baffles for capturing froth that is formed on the surface of the solution in the tanks.
Figure 3:
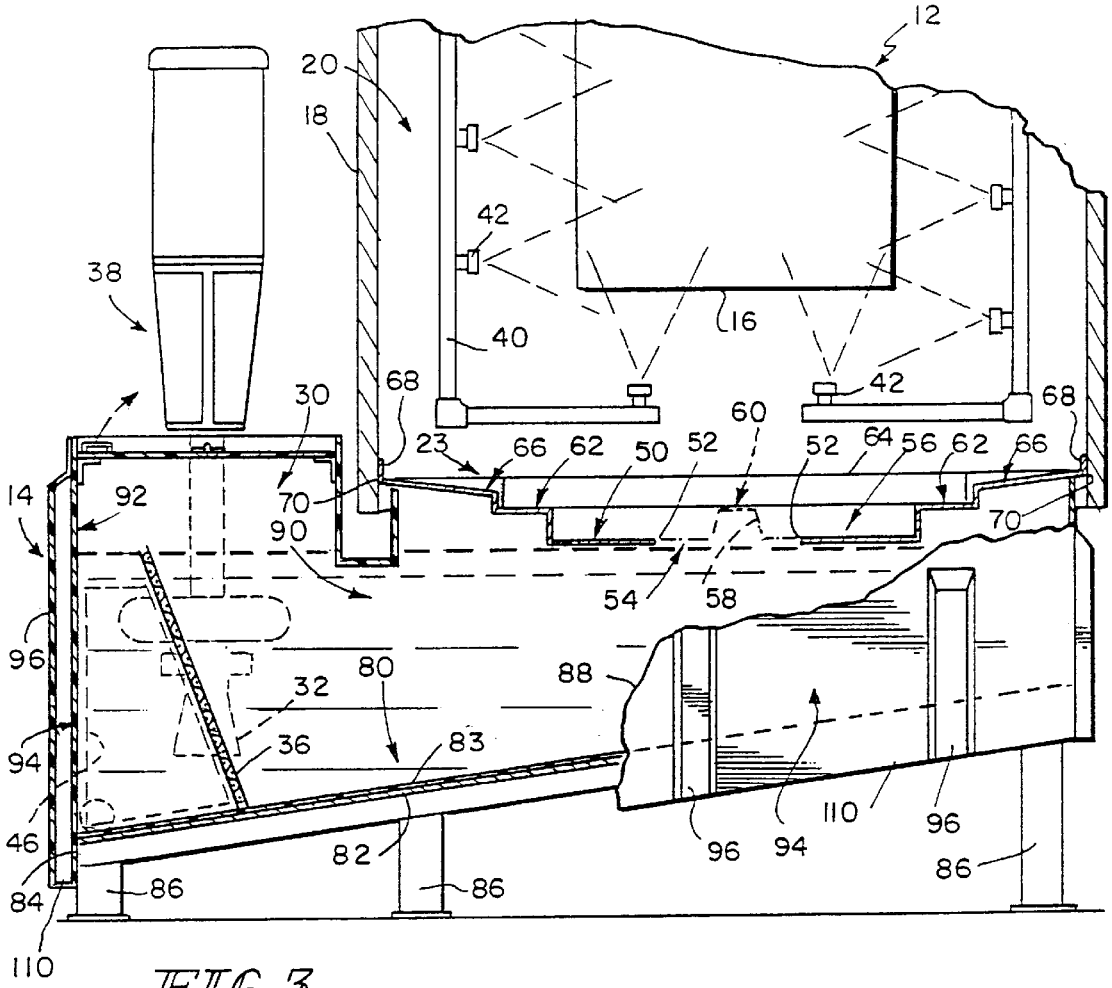
FIG. 3 is a sectional view taken along line 3—3 of FIG. 1 showing a tank filled with rinsing solution, the tank having a sloped bottom that is sloped toward a filter screen positioned to lie in front of a suction pipe, a pump extending into the tank for pumping solution from the tank, through the suction pipe, and providing pressurized solution to delivery pipes of the post rinse machine that spray the rinsing solution on to work pieces, the solution draining from the work pieces and from the walls of the housing of the post rinse machine down along a drain board, back into the tank, and to the pump to be recycled and sprayed on subsequent work pieces.

An illustrative industrial finishing equipment line includes an electrodeposition coating station 10 and a post rinse machine 12 for rinsing work pieces following an electrodeposition coating step completed in electrodeposition coating station 10 as illustratively shown in FIGS. 1 and 2. Preferably, work pieces 16, shown in FIG. 3, are attached to a conveyor (not shown) which moves work pieces through the industrial finishing equipment line from electrodeposition coating station 10, through post rinse machine 12, and to a subsequent operation such as a drying or cooling station.

Post rinse machine 12 illustratively includes a pair of cascading rinse tanks 14 in accordance with the present invention as shown in FIGS. 1 and 2. While tanks 14 are described herein with respect to illustrative post rinse machine 12, it should be understood that tanks 14 can be used on other industrial finishing equipment without exceeding the scope of the invention as presently perceived. For example, tanks 14 in accordance with the present invention can be part of a washer (not shown) or part of other types of industrial finishing equipment (not shown).

Post rinse machine 12 preferably includes a housing 18 such as, for example, the housing described in U.S. patent application Ser. No. 08/494,032 to Carl et al., filed Jun. 23, 1995, the specification of which is herein incorporated by reference. Housing 18 defines an interior region 20 of post rinse machine 12 as shown in FIGS. 1 and 2. Interior region 20 is further defined by drain boards 22 which are positioned to lie beneath housing 18.

Drain boards 22 extend from a first end 24 of post rinse machine 12 adjacent to the "exit" of post rinse machine 12 where work pieces 16 move to the subsequent operation, and a second end 26 of post rinse machine 12 adjacent to electrodeposition coating machine 10 where work pieces 16 move from the electrodeposition coating process to the post rinse process performed in post rinse machine 12. Drain boards 22 and tanks 14 thus define the "floor" of post rinse machine 12 and the bottom of interior region 20 of post rinse machine 12. Work pieces 16 are moved through interior region 20 above drain boards 22 and rinse tanks 14 which are positioned to lie beneath the path travelled by work pieces 16.

As rinsing solution is sprayed on work pieces 16 passing through post rinse machine 12, the rinsing solution is splashed onto walls of housing 18 and drips from both the walls of housing 18 and from work pieces 16 onto drain boards 22. Drain boards 22 are sloped from first end 24 toward second end 26, preferably at a slope having a vertical drop of about one inch (2.5 cm) for every 8 feet (2.4 m) of travel so that rinsing solution flows from first end 24 toward second end 26. Baffles 28 are attached to tanks 14 as shown in FIG. 2 to allow the flow of rinsing solution toward second end 26 while halting the flow of froth that commonly forms and accumulates on top of rinsing solution in tanks 14. Eventually, the rinsing solution flows from post rinse machine 12 into electrodeposition coating station 10 where the rinsing solution can be used in the electrodeposition coating process.

Each rinse tank 14 is preferably formed to include a pumping chamber 30 as illustratively shown in FIG. 3. Pumping chamber 30 is preferably set apart from tank 14 and is defined by a wall 44 formed to include a trapezoid-shaped opening 46 as shown best in FIGS. 4 and 6 and a filter screen 36 is positioned to lie between pumping chamber 30 and the rest of tank 14.

A suction pipe 32 having an opening 34 is received in pumping chamber 30 as shown in FIG. 3 and is in fluid communication with a pump 38 that draws rinsing solution from tank 14 through filter screen 36 and suction pipe 32 and provides the pressurized rinsing solution to solution delivery pipes 40 having delivery nozzles 42. Solution sprayed onto work pieces 16 from nozzles 42 drips from the outsides of solution delivery pipes 40, the inside of housing 18, and from work pieces 16 themselves onto drain board 22 and back into tank 14.

As the rinse solution recirculates between work pieces 16 and tank 14, froth tends to accumulate on the surface of the rinse solution. If left unchecked, the froth can accumulate and interefere with the operation of pump 38, it can run out of post rinse machine 12 and onto the floor, or it can flow from post rinse machine 12 into electrodeposition coating station 10 where it can interfere with the electrodeposition coating process. As described above, baffles 28 control some of the froth that accumulates in post rinse machine 12. In addition, pumping chamber 30 includes a top 44 that is spaced apart from the surface of the rinse solution to provide extra space for the froth so that the froth does not interfere with the operation of pump 38 and so that the froth does not overflow out of the lid of pumping chamber 30.

Each drain board 22 is positioned to lie underneath housing 18 and is generally centered below the conveyor (not shown) so that drain boards 22 are positioned to lie beneath work pieces 16 as shown in FIG. 3 as work pieces travel through post rinse machine 12. If desired, additional drain boards 23 can be positioned to lie over tanks 14 as illustratively shown in FIGS. 3 and 7. Typically, drain boards are included over the tanks of washers while drain boards are typically not included over the tanks of rinse machines such as post rinse machine 12. Tanks 14 can accommodate drain boards 23 if desired as described herein.

Each drain board 23 includes an upwardly facing wall 50 having an inner edge 52 defining a solution-return opening 54. The wall 50 of the drain board 23 is formed to include an elongated interior trough 56 and trough 56 can be formed to include a central support 58 (in phantom) having a supplemental grate-seating surface 60. Central support 58 is provided on large drain boards 23 to provide additional support for grating sections 64 that are received thereon as described below.

Solution-return opening 54 is positioned to lie in trough 56. Wall 50 is formed to further include two elongated grate-seating surfaces 62 positioned to lie along outer sides of trough 56 and two elongated draining surfaces 66 positioned to lie along outer sides of grate-seating surfaces 62, as shown in FIG. 3. A flange 68 is appended to the outer edge 70 of each draining surface 66. In preferred embodiments, each drain board 23 is configured to direct run-off sprayed solution to the center trough 56. The solution flows through opening 54 to tank 14 positioned to lie beneath opening 54.

Each drain board 23 is designed to support grating sections 64, which are received on the grate-seating surfaces 60, 62 of the drain board 23, as shown in FIG. 3. Central support 58 can optionally be included on drain board 23 to provide additional structural rigidity to drain board 23 and to provide additional support for grating sections 64. Grating sections 64 can be provided over the entire length of post rinse machine 12, in certain sections of the post rinse machine 12, or they can be omitted completely.

Each drain board 22, 23 typically rests on tank 14 for support as shown in FIG. 3. Each tank 14 has a bottom 80 that is sloped toward opening 34 of suction pipe 32 as illustratively shown in FIG. 3. The slope operates to minimize the volume of tank 14 so that the amount of rinsing solution used by post rinse machine 12 can be minimized. In addition, the slope causes particulate impurities, such as paint or other coating particulates that can accumulate in the rinsing solution forming "sludge," to tend to move toward filter screen 36 so that the sludge can be easily removed from the system. Thus, filter screen 36 operates both to prevent particulates from entering the suction pipe 32, pump 38, solution delivery pipes 40, and nozzles 42, while also facilitating the cleaning of tank 14.

Figure 4:
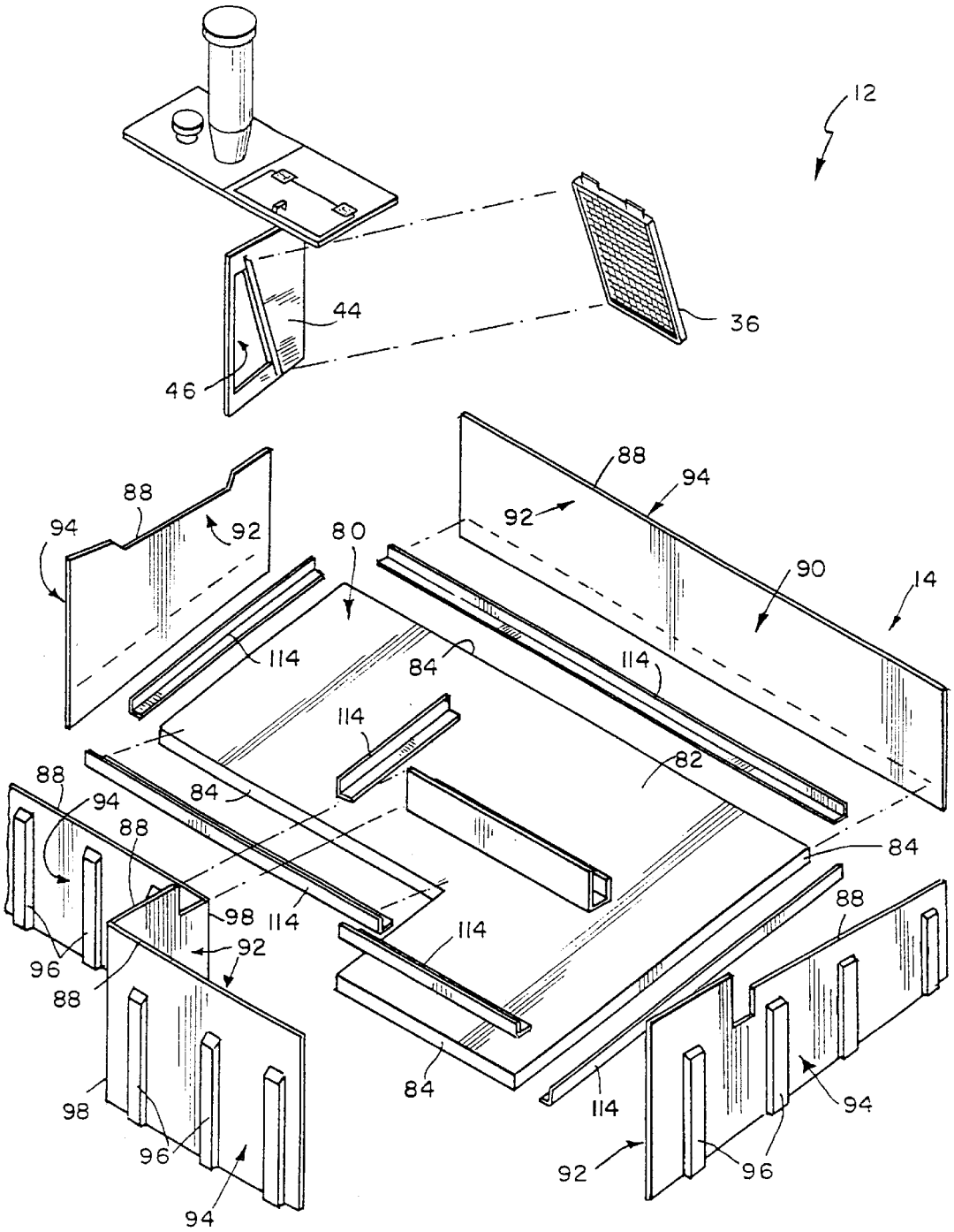
FIG. 4 is an exploded view of the tank of FIG. 3 showing a bottom plate having an L-shaped "foot print," six generally planar wall panels adjacent to the perimeter edges of the bottom plate, each wall panel being formed to include a plurality of ribs for providing structural strength to the wall panels, a fiberglass reinforced plastic strap positioned to lie adjacent to the edges of the bottom plate and the wall panels along the edges of the bottom plate, and the screen and a lid of the pumping chamber of the tank.

Bottom 80 of tank 14 includes a plate 82 as shown in FIG. 4 and a coating 83 of fiberglass reinforced plastic (FRP) that coats plate 82. Thus, plate 82 can be made from any suitable material that can provide a substrate for the FRP including materials such as black iron, stainless steel, and wood. Plate 82 can be shaped to provide tank 14 with a "foot print" to suit the installation space available for tank 14.

For example, as illustratively shown in FIG. 4, plate 82 can be L-shaped to provide tank 14 with an L-shaped foot print. For another example, plate can include a generally rectangular first portion and a generally rectangular second portion integrally appended to the first portion so that the plate is generally T-shaped. For yet another example, plate can include a generally rectangular first portion having a first end and a second end, a generally rectangular second portion integrally appended to the first end of the first portion, and a generally rectangular third portion integrally appended to the second end of the first portion so that the plate has a "squared S-shape" having the shape of a squared letter S. In addition, plate 82, and thus tank 14, can have any other desired shaped so long as edges 84 of plate 82 are generally straight edges as described below.

If desired, legs 86 can be attached to plate 82 as shown in FIG. 3. Legs 86 allow plate 82 and tank 14 to be elevated above the floor. In addition, providing legs 86 having varying heights allows bottom 80 of tank 14 to be sloped when tank 14 is installed as shown in FIG. 3.

Wall panels 88 are attached to plate 82 and cooperate with plate 82 to define an interior region 90 of tank 14 as shown in FIG. 4. Wall panels 88 are preferably of unitary construction and are made from FRP. In preferred embodiments, Hetron FR 992 manufactured by the Composite Polymers Division of Ashland Chemical Company, a division of Ashland, Inc. of Columbus Ohio, is the fiberglassing resin used to produce wall panels 88, although any suitable resin may be used. However, it is within the scope of the invention as presently perceived to provide wall panels 88 made using any type of fiberglass.

Wall panels 88 made from Hetron FR 992 resin have an insulating value that is somewhat better than steel. A fire retardant, either APE 1540 pentoxide or antimony trioxide, is preferably added to the resin to give wall panels 88 a class 1 fire rating with flame spread of 25 or less on the scale established by the ASTM E84 tunnel test. In preferred embodiments, wall panels 88 have an exterior colored gel coat coating.

Each wall panel 88 has a generally planar inner side 92 defining interior region 90 of tank 14 and an outer side 94 that is preferably formed to include a plurality of generally vertically-extending ribs 94 as shown in FIG. 4. Ribs 94 are integrally appended to wall panels 88 and are configured to provide additional structural strength to wall panels 88.

Figure 5:
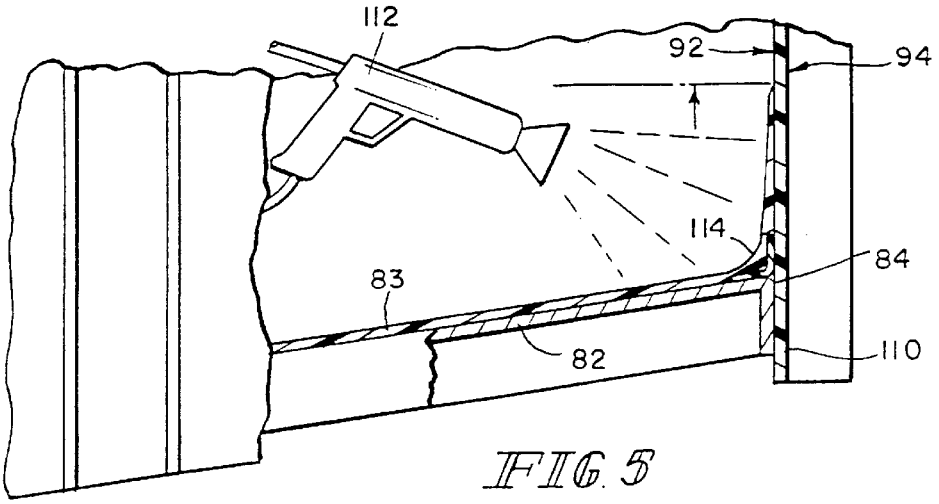
FIG. 5 is an enlarged view of a portion of the tank with portions broken away showing fiberglass reinforced plastic being applied to an upwardly-facing top surface of the bottom plate and to bottoms of the wall panels adjacent to the bottom plate by a chopper gun to provide the bottom plate with a seamless construction.
Figure 6:
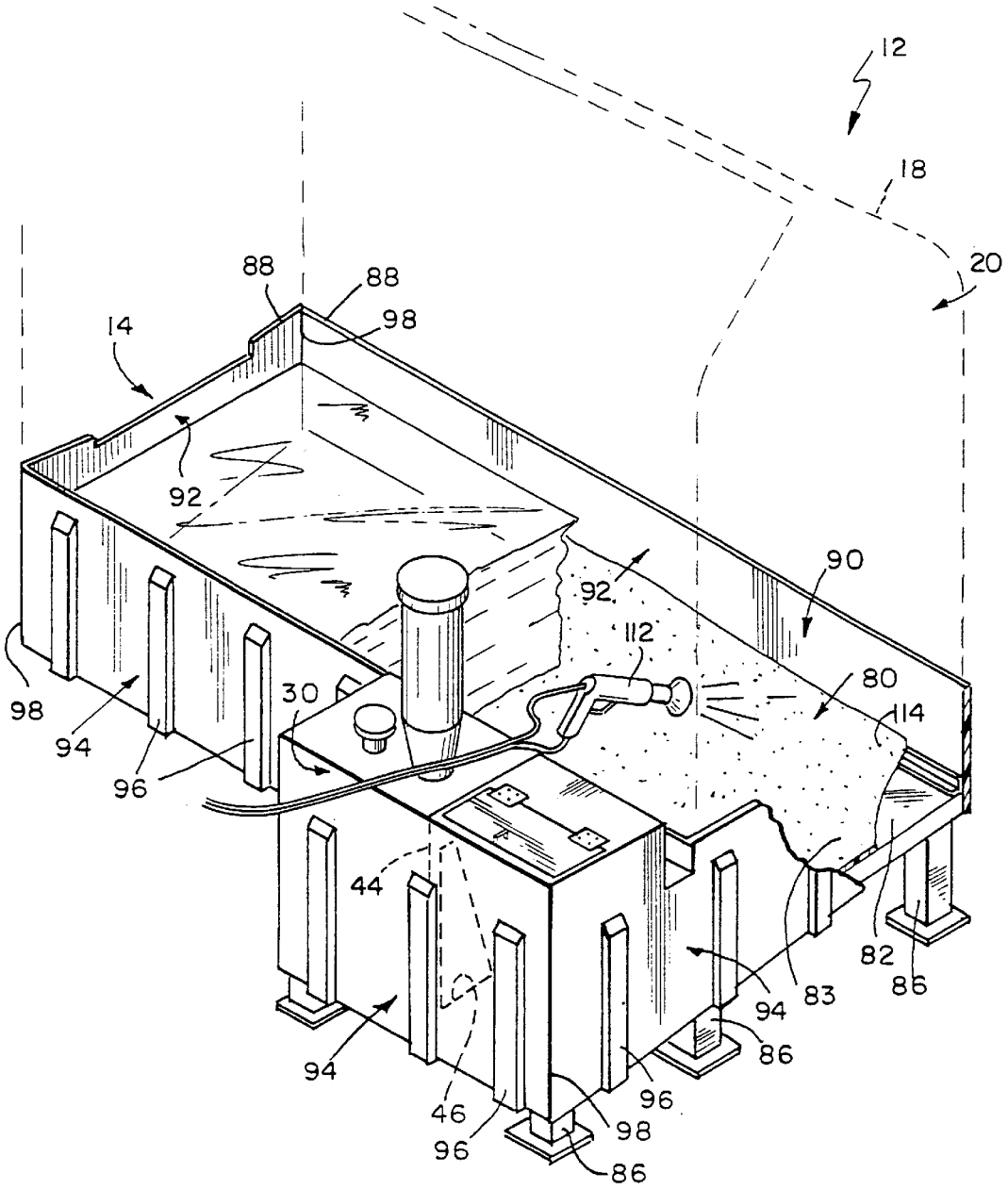
FIG. 6 is a perspective view of the tank of FIG. 4 showing the tank positioned to lie beneath a housing for industrial finishing equipment (in phantom) and having portions broken away showing the application of fiberglass reinforced plastic along the entire top surface of the bottom plate and along the bottoms of the wall panels adjacent to the bottom plate.

Once plate 82 and wall panels 88 are obtained, tank 14 is assembled by clamping wall panels 88 to plate 82 and "glassing" each wall panel 88 to each adjacent wall panel 88 and by glassing wall panels 88 to plate 82 as shown in FIGS. 4–6. Wall panels 88 are made from FRP so that the process of glassing wall panels 88 together includes roughening the engaging surfaces of wall panels 88 and bonding wall panels 88 with a fiberglassing resin. A fillet 98 may be formed between adjacent wall panels 88 and is typically made from a mill-fiber putty and is covered by additional fiberglassing resin and fiberglass mat applied in one, two, or more layers depending upon the thickness desired.

The structure at the joints between wall panels 88 when wall panels 88 are glassed together provides for a smooth and continuous interior surface along the entire inner side 92 of wall panels 88 defining interior region 90 of tank 14. Additionally, glassing together wall panels 88 provides a water impermeable seal between wall panels 88 while also making it easier to keep wall panels 88 clean and free of debris. Although the preferred joining structure of wall panels 88 is produced by glassing wall panels 88 together, it is within the scope of the invention as presently perceived to join wall panels 88 by any suitable joining technique including bolting wall panels 88 together, riveting wall panels 88 together, gluing wall panels 88 together, and simply clamping wall panels 88 together.

Wall panels 88 can be positioned adjacent to plate 82 to form a skirt 110 extending downwardly past plate 82 to the floor as shown in FIGS. 3 and 5 or wall panels 88 can be positioned so that there is no skirt as shown in FIG. 6. Advantageously, tank 14 can be produced using either hand lay-up techniques applying alternating layers of resin and fiberglass mat or by spraying-on resin and fiberglass using a chopper gun 112 as shown in FIGS. 5 and 6.

In preferred embodiments, an FRP strap 114 is applied to wall panels 88 and plate 82 in the corners defined by the intersections of wall panels 88 and plate 82 as shown in FIGS. 4 and 5 to ensure that a water impermeable seal is formed therebetween. Strap 114 is preferably a "rolled" sheet material that is unrolled and applied to the corners of tank 14 as shown in FIGS. 4 and 5. FRP is applied only to a portion of wall panels 88 that extends upwardly on wall panels 88 about 4 inches (10.2 cm) above plate 82 and that is tapered having the thickness of the FRP decrease farther away from the corners so that even with the addition of FRP strap 114, inner sides 92 of wall panels 88 are smooth and appear to be generally planar.

In addition, plate 82 is coated by coating 83 of FRP that is about ¼ inch (6.4 mm) thick. Including FRP strap 114 and FRP coating 83 on plate 82 provides an inner coating of FRP on all interior surfaces of tank 14 so that tank 14 is corrosion resistant. In preferred embodiments, the resin used for the interior of tank 14 is a high grade resin which is used with a veil package so that the inner sides 92 of wall panels 88 are smooth. The veil is a fine fiberglass cloth that is applied to inner sides 92 forming a resin-rich layer on the surface of each wall panel 88 so that glass does not protrude from the resin. The resin provides the FRP with the chemical resistance so that the smooth resin-rich surface adds to the corrosion resistance of tank 14. Thus, while the outer sides 92 of wall panels 88 are covered with gel coat, as described above, to provide a smooth coating on outer sides 94, the veil facilitates producing a resin-rich corrosion-resistant coating on inner sides 92 of tank 14.

It can be seen that by producing tank 14 with wall panels 88 made from FRP and having bottom 80 including plate 82 coated with FRP, all surfaces of tank 14 contacting rinsing solution are coated with FRP and are, thus, corrosion resistant. As a result, plate 82 may be made from any suitable material that can be coated by FRP and that can act as a substrate for the FRP, even materials that are not corrosion resistant on their own. For example, plate 82 can be made from black iron, a material that can corrode when exposed to deionized water (DI water), instead of from more expensive materials such as stainless steel. Of course, plate 82 can also be made from other materials that can serve as a substrate for the FRP.

Figure 7:
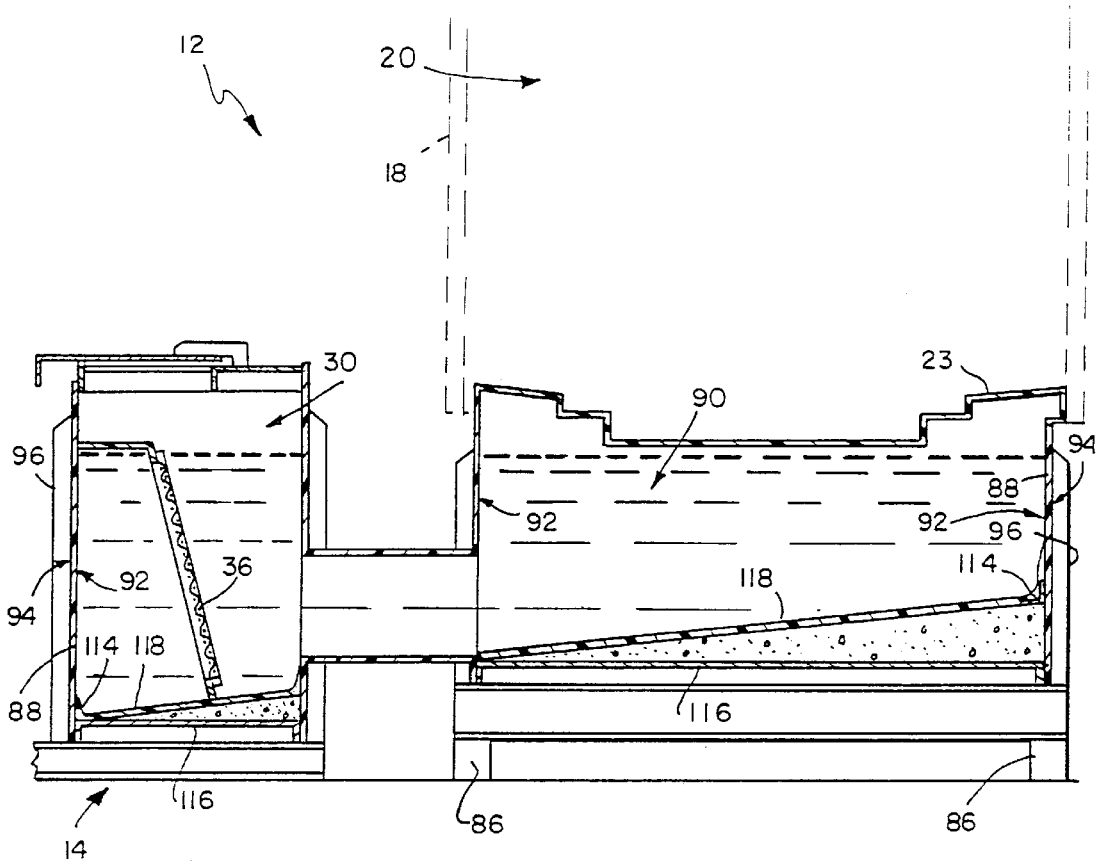
FIG. 7 is a view similar to FIG. 3 of the tank in accordance with the present invention having a bottom plate made from foam having the shape of a wedge.
Figure 8:
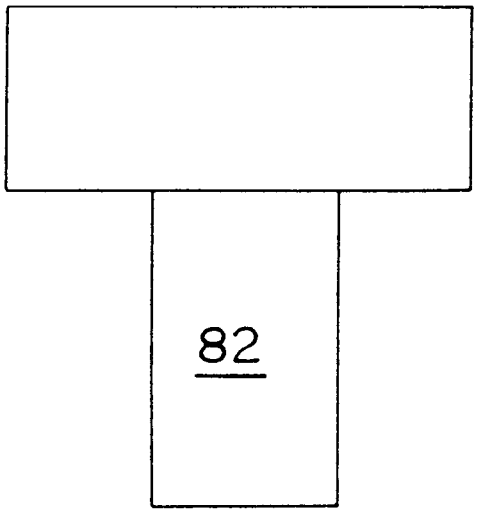
FIGS. 8 and 9 show alternative and different "T" and "S" configurations for the tank bottom.
Figure 9:
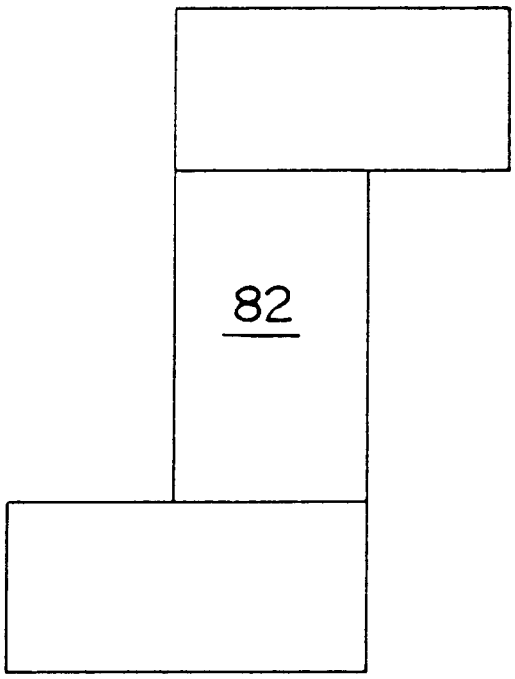

If desired, plate 82 can be made from a material such as isocyanurate-polyurethane foam commonly used as insulation material (hereinafter foam) as illustratively shown in FIG. 7. Foam plate 82 is preferably cut to have a cross section forming a wedge so that an inside bottom wall 118 of tank 14 slopes toward opening 34 of suction pipe 32 while an outside bottom wall 116 of tank 14 is generally horizontal, increasing the ease of installation of tank 14.

Outside bottom wall 116 of tank 14 is typically constructed in a manner similar to wall panels 88 described above so that outside bottom wall 116 is a ribbed firberglass panel providing structural support to tank 14 having foam plate 82. Typically, wall panels 88 are clamped to bottom wall 116 and wall panels 88 are glassed to one another and are glassed to bottom wall 116 as described above for wall panels 88 and plate 82. Once this assembly is complete, foam plate 82 is placed against bottom wall 116 and FRP is applied to a top surface of foam plate 82 to form inside bottom wall 118 as shown in FIGS. 6 and 7. Inside bottom wall 118 completely covers foam plate 82 and engages each wall panel 88 to form a water impermeable seal between side panels 88 and foam bottom plate 82.

The conveyor (not shown) continuously moves work pieces 16 through the post rinse machine 12 as illustratively shown in FIG. 3. Delivery pipes 40 are positioned to lie adjacent to housing 18 of the post rinse machine 12 and the nozzles 42 are spaced apart and are aimed toward the interior of the post rinse machine 12 so that work pieces 16 are drenched by the rinsing solution as the work pieces 16 pass through post rinse machine 12.

If drain boards 23 are provided, openings 54 in drain boards 23 receive sprayed rinsing solution that runs off of work pieces 16, housing 18, and other surfaces positioned to lie in interior region 20 of post rinse machine 12. The rinsing solution flows into tank 14 that is positioned to lie underneath the opening 54 to be recycled for later use. Grating sections 64 are positioned over openings 54 to prevent foreign material from entering tank 14 through openings 54. The grating sections 64 also provide a walking surface for maintenance workers working inside of the housing 18.

Construction from fiberglass reinforced plastic provides improved resistance to corrosion at a cost that is less than the cost of stainless steel. The use of fiberglass reinforced plastic also provides exceptional flexibility with respect to the sizes and shapes of the assorted component parts. Ribs 96 stiffen wall panels 30 thereby allowing for the post rinse machine 12 to be built with no internal support frame, which would typically be made from steel. Building tank 14 from plate 82 that provides a substrate for receiving FRP thus provides a tank for use in industrial finishing equipment that is inexpensive and easy to manufacture and yet can withstand exposure to corrosive chemicals without deteriorating significantly.

Although the invention has been described in detailed with reference to preferred embodiments, additional variations and modifications exist within the scope and spirit of the invention as described and defined in the following claims.

We claim:

1. A composite tank for a rinse system, the tank comprising a plate, a plurality of general planar fiberglass reinforced plastic walls attached to the plate and extending generally upwardly therefrom, the walls cooperating with the plate to define an interior region of the tank, and a generally planar bottom wall positioned to lie above the plate and received in the interior region of the tank, the bottom wall being made from fiberglass reinforced plastic and attached to the reinforced plastic walls to provide a sealed interior region of the tank between the walls and the bottom wall and above the plate.

2. The composite tank of claim 1, wherein each wall panel is formed to include a generally planar inner surface defining the interior region of the tank, a generally planar outer surface, and a plurality of ribs integrally appended to the outer surface to provide structural rigidity to the wall panel.

3. The composite tank of claim 1, wherein the tank is formed to include a pumping chamber and further comprising a suction pipe received in the pumping chamber so that fluid is withdrawn from the tank through the pumping chamber.

4. The composite tank of claim 1, wherein the plate is made from steel.

5. The composite tank of claim 1, wherein the plate is made from black iron.

6. The composite tank of claim 1, wherein the plate is made from wood.

7. The composite tank of claim 1, wherein the plate includes a wedge made from foam and coated with fiberglass reinforced plastic.

8. The composite tank of claim 1, wherein the plate is generally rectangular.

9. The composite tank of claim 1, wherein the plate includes a generally rectangular portion and a second portion integrally appended to the generally rectangular portion so that the plate is L-shaped, the interior region of the tank adjacent to the second portion defining a pumping chamber.

10. The composite tank of claim 1, wherein the plate includes a generally rectangular portion and a second portion integrally appended to the generally rectangular portion so that the plate is generally T-shaped.

11. The composite tank of claim 1, wherein the plate includes a first generally rectangular portion having a first end and a second end, a second portion integrally appended to the generally rectangular portion adjacent to the first end, and a third portion integrally appended to the generally rectangular portion adjacent to the second end so that the plate has a squared S shape.

12. A composite tank for a rinse system, the tank comprising a plate, a plurality of general planar fiberglass reinforced plastic walls attached to the plate and extending generally upwardly therefrom, the walls cooperating with the plate to define an interior region of the tank, a bottom wall positioned to lie above the plate, extending to the walls, and received in the interior region of the tank, the bottom wall being made from fiberglass reinforced plastic, and further comprising a fiberglass reinforced plastic strap positioned to lie adjacent to a corner defined by one of the walls and the plate so that the corner defined by the walls and the plate is water impermeable.

13. A composite tank for a rinse system, the composite tank comprising an outside bottom wall, a plurality of wall panels attached to the outside bottom wall and extending upwardly therefrom, a plate positioned to lie on top of the outside bottom wall, and an inside bottom wall formed on top of the plate and forming a water impermeable barrier between the plate and the plurality of wall panels so that the inside bottom wall cooperates with the plurality of wall panels to define a sealed interior region of the tank between the bottom wall and the wall panels.

14. The composite tank of claim 13, wherein the plate has a top surface and a bottom surface cooperating with the top surface to define a generally wedge-shaped cross section and the outside bottom wall is generally horizontal and engages the bottom surface of the plate so that the top surface of the plate and the inside bottom wall of the tank formed on the top surface of the plate are sloped relative to the outside bottom wall of the tank.

15. The composite tank of claim 14, wherein the plate is made from foam.

* * * * *